United States Patent [19]

Dauphine

[11] 4,193,451

[45] Mar. 18, 1980

[54] METHOD FOR PRODUCTION OF ORGANIC PRODUCTS FROM KEROGEN

[75] Inventor: Thonet C. Dauphine, Acton, Mass.

[73] Assignee: The Badger Company, Inc., Cambridge, Mass.

[21] Appl. No.: 845,504

[22] Filed: Oct. 25, 1977

Related U.S. Application Data

[63] Continuation of Ser. No. 696,976, Jun. 17, 1976, abandoned.

[51] Int. Cl.[2] ..... E21B 43/24; E21B 43/26

[52] U.S. Cl. ..... 166/248; 166/271

[58] Field of Search ..... 166/248, 272, 302, 60, 166/249, 271; 208/11 R

[56] References Cited

U.S. PATENT DOCUMENTS

| | | | |
|---|---|---|---|
| 1,372,743 | 3/1921 | Gardner | 166/60 X |
| 2,757,738 | 8/1956 | Ritchey | 166/248 |
| 2,795,279 | 6/1957 | Sarapuu | 166/248 |
| 3,133,592 | 5/1964 | Tomberlin | 166/60 |
| 3,497,005 | 2/1970 | Pelopsky et al. | 166/249 X |
| 3,696,866 | 10/1972 | Dryden | 166/248 |
| 3,848,672 | 11/1974 | Bodine | 166/249 |
| 3,948,319 | 4/1976 | Pritchett | 166/248 |
| 3,989,107 | 11/1976 | Fisher et al. | 166/248 |
| 4,008,762 | 2/1977 | Fisher et al. | 166/272 X |

FOREIGN PATENT DOCUMENTS

| | | | |
|---|---|---|---|
| 321910 | 11/1929 | United Kingdom | 208/11 R |

*Primary Examiner*—Stephen J. Novosad
*Assistant Examiner*—George A. Suchfield
*Attorney, Agent, or Firm*—M. D. Bartlett; J. D. Pannone; H. W. Arnold

[57] ABSTRACT

A method of producing fluid organic products from kerogen in situ in a body of oil shale by the application of alternating electric fields having a frequency between 100 kilohertz and 100 megahertz to heat the kerogen in the oil shale to a temperature in the range of 200° C. to 360° C. and to maintain the kerogen in this temperature range for a period of time sufficient to convert a substantial portion of the kerogen in oil shale to fluid organic products which may be collected through fissures produced in the oil shale formation by flowing to a well bore having a collection sump.

11 Claims, 3 Drawing Figures

METHOD FOR PRODUCTION OF ORGANIC PRODUCTS FROM KEROGEN

CROSS-REFERENCE TO RELATED CASES

This is a continuation of application Ser. No. 696,976, filed June 17, 1976, now abandoned.

BACKGROUND OF THE INVENTION

The production of organic products from bodies of oil shale comprising layers of kerogen embedded in a mineral formation has heretofore been accomplished by mining and suitably pulverizing the formation of oil shale. The shale is then retorted above ground and products derived from kerogen are driven off from the shale. In order to achieve sufficiently rapid decomposition of kerogen to obtain efficient and economical utilization of equipment, temperatures around or above 500° C. (or higher) have generally been used, and at such temperatures the kerogen in the shale is partially converted into liquid organic products having high pour points, which require hydrogenation to convert the products to low pour point liquids suitable for flowing through pipe lines at normal temperatures.

In addition, the capital cost of such mining equipment and the retorting energy cost tend to render shale mining and above ground retorting processes economically unattractive.

Also, the spent shale from the above ground retorting process has a volume substantially greater than the volume of the original shale, and creates a major disposal problem. Also, water soluble products in the spent shale can be a source of pollution to surrounding areas.

Attempts to convert kerogen to liquid and gaseous products in situ in the oil shale by injecting heated fluids, such as steam, methane or hot combustion gases, through injection wells, or by putting a D.C. voltage between spaced wells, have generally been unsatisfactory and produced little or no yield of shale oil. An important reason for this is the fact that oil shale is generally found as an impervious monolithic stratum without suitable fractures or passages for accepting the flow of heated fluids intended to heat the structure. In addition, if the heating depends entirely on thermal conduction through the shale, the shale will require periods of time on the order of years for the temperature to be uniformly distributed through a large body of oil shale by thermal conduction, if fractured by conventional oil field methods using hydrostatic pressure, which have generally proved to be inadequate for producing conduits for fluid heating media.

SUMMARY OF THE INVENTION

This invention provides for producing organic liquid and vapor products in situ from oil shale by heating the kerogen in the shale to a temperature range between 200° C. and 360° C. where such organic products are produced by conversion of the kerogen.

More specifically, this invention discloses subjecting a body of oil shale to alternating electric fields having frequencies in the range of 100 kilohertz to 100 megahertz, hereinafter referred to as radio frequencies or R.F., to produce controlled heating of the kerogen in the oil shale body to temperatures above 200° C. and preferably below 360° C., where the kerogen converts to fluid organic products over a period of hours to months. The major portion of the organic products converted from kerogen in this temperature range are low pour point liquids, in contrast to products produced by above ground retorting around 500° C., which produces products the major portion of which are high pour point liquids.

This invention further discloses that the electric field applied to a body of oil shale in situ may be shaped and controlled by utilizing a plurality of electrodes positioned at various points in an oil shale body to produce a more uniform dispersion of an R.F. field, resulting in a more uniform and controllable temperature within the oil shale body.

This invention further discloses that pressure may be produced in the bore hole of a producing well or sump in an oil shale body while heat is produced in the ore body by R.F. fields to prevent collapse of fissures in the ore body produced by the R.F. heating. More specifically, gas under pressure may be introduced into the bore hole through one electrode of the R.F. field producing system and/or may be generated in the shale formation by vaporization of water, and/or hydrocarbons and/or decomposition of temperature sensitive carbonate minerals.

This invention further discloses that electrode structures for the R.F. field may be energized with different phases of the R.F. energy which may be cyclically varied with time to produce shifts in the location of maximum R.F. field in the oil shale body to control temperature gradients.

BRIEF DESCRIPTION OF THE DRAWINGS

Other and further objects and advantages of the invention will become apparent as the description thereof progresses, reference being made to the accompanying drawings wherein.

DESCRIPTION OF THE PREFERRED METHOD

Figure 1:
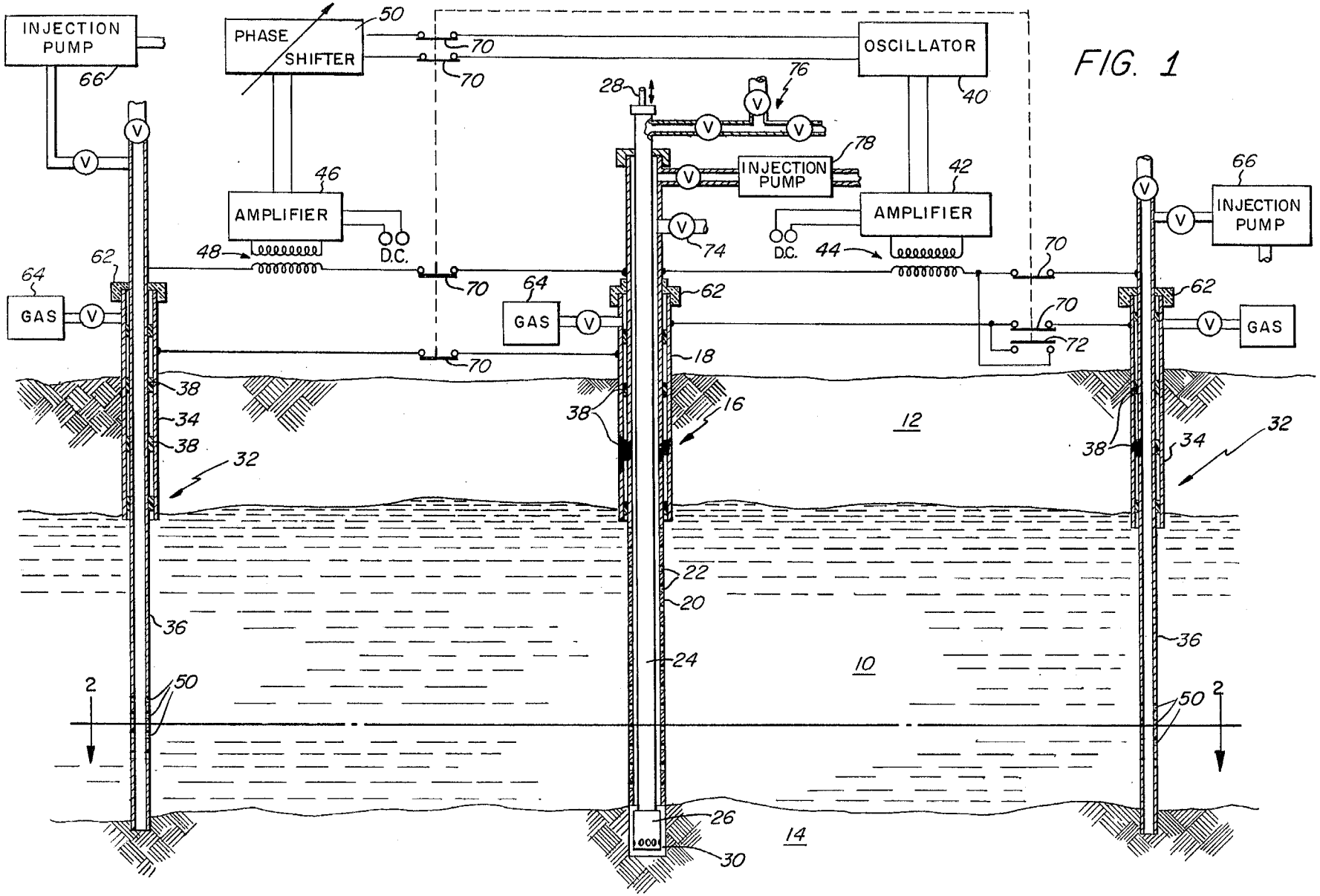
FIG. 1 illustrates a system for supplying R.F. energy to an in situ body of oil shale.
Figure 2:
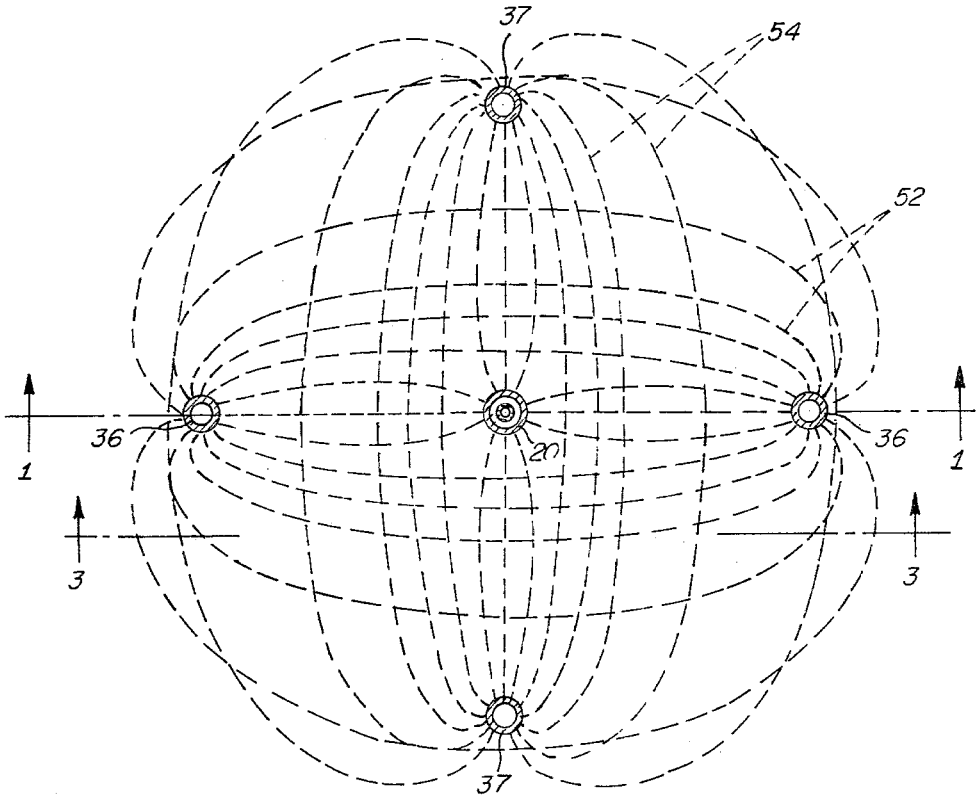
FIG. 2 illustrates a sectional view of the system of FIG. 1 taken along line 2—2 of FIG. 1.
Figure 3:
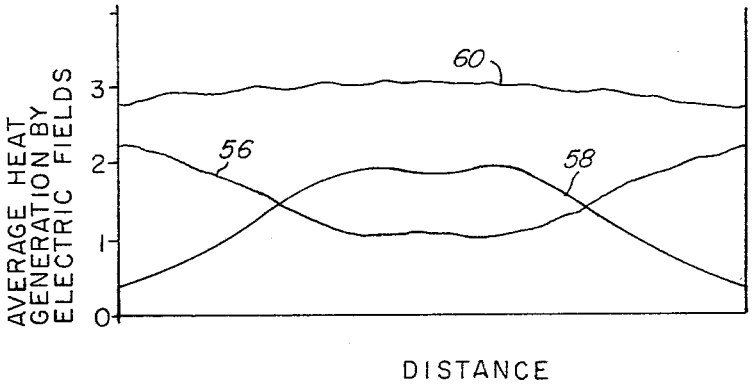
FIG. 3 illustrates the heating produced by the electric fields used in the structure of FIGS. 1 and 2.

Referring now to FIGS. 1 through 3, there is shown a body of oil shale 10 lying between an overburden 12 and a substratum 14.

A well 16 is drilled through overburden 12, oil shale 10 and into substratum 14. Well 16 may have, for example, an outer casing 18 extending only through the overburden 12 and with an inside diameter of ten inches. A second casing 20 is positioned inside casing 18 and has an outside diameter of, for example, eight inches. Casing 20, which acts as an electrical conductor, may be, for example, steel coated with copper and extends through oil shale stratum 10 substantially to substratum 14. As shown, electrode 20 has perforations 22 where it passes through a region of oil shale body 10 to allow fluid organic products converted from the kerogen in the oil shale to pass into the interior of electrode 20. Such perforations may be of any desired size and spacing, depending on the rate of production of fluid from the oil shale body 10 and on the size of fractured pieces of the body 10 to be prevented from passing into electrode 20.

Positioned inside electrode 20 is a producing tubing 24 which is connected to a pump 26 attached to the bottom of tubing 24 and positioned, for example, in a sump 30 which collects the liquid organic products (not shown) converted from kerogen in the oil shale body 10. A sucker rod 28 may be used to actuate pump 26 to produce reciprocating motion of a plunger therein in accordance with well-known practice. However, if desired, other types of pumps such as electrically operated submersible pumps may be used, or gas pressure in the casing 20 may be used to force liquids up tubing 24.

Spaced from casing 18 in the oil shale body are a plurality of electrode structures 32 drilled from the surface of overburden 12 and comprising outer casings 34 extending from the surface of overburden 12 to body 10 and electrode structures 36 positioned inside casings 34 and preferably extending through body 10. Electrodes 36 may be, for example, two-inch diameter steel pipe coated with conductive material such as copper or nickel chrome alloys. Electrically insulating bushings 38 are used to space electrodes 20 and 36 from casings 18 and 34, respectively.

Oscillator 40 produces an electrical alternating current which is amplified by a first amplifier 42 whose output is coupled between electrode 20 and all of the electrodes 36 by a transformer 44. The frequency of oscillator 40 is preferably in the range between 100 kilohertz and 100 megahertz, and the output of transformer 44 produces an alternating electric field in body 10 to heat the kerogen in body 10.

The spacing between structures 16 and 32 in the shale body 10 is preferably made less than one-eighth of a wavelength of the frequency of oscillator 40. For example, if this spacing is forty feet at a frequency of one megahertz, the spacing would be on the order of one-tenth of a wavelength in the shale. Hence, the electric field configuration will have a very low radiated component and the majority of the energy will be absorbed in the body 10 between the electrodes.

As shown in FIG. 2, a plurality of electrode structures are positioned on either side of well 16, spaced therefrom by a predetermined distance such as ten feet to several hundred feet. With the amplifier 42 supplying an A.C. voltage between the electrode 20 of well 16 and the electrode 36 of one of the structures 32 and another amplifier 46 supplying an A.C. voltage between the other electrode structure 32 and electrode 20 through transformer 48, synchronized to oscillator 40 through phase shifter 50, a field pattern of the general shape shown in FIG. 2 by field lines 52 occurs in the body 10 when phase shifter 50 is adjusted to produce an output voltage from transformer 48 out of phase with that of transformer 44. The intensity of the A.C. field, as indicated by the inverse of the spacings between the lines 52, is proportional to the sum of the voltage outputs of the transformers 44 and 48.

Since the heating of the kerogen in body 10 is proportional to the square of the electric field, heating is more intense in the immediate region of the electrode structures. However, in accordance with this invention, heating may be made more uniform by first applying the heating voltage between the electrodes 36 for a period of time, such as an hour, and then shifting the voltage by switches (not shown) to a second set of electrodes 37 spaced from electrode 20 at right angles to electrodes 36 and at the same distance as electrodes 36 to produce the electric field pattern shown by lines 54, as indicated in FIG. 2.

FIG. 3 shows the average heating effects of the field patterns 52 and 54 along line 3—3 of FIG. 2. Curve 56 is the average heating effect of field 52, curve 58 is the average heating effect of field 54, and curve 60 is the sum of curves 56 and 58. Thus, improved temperature uniformity can be achieved by time sequencing the heating voltages applied to the electrodes 36 and 37, and the heating rates may be thus adjusted by adjusting the timing sequence and the field pattern. While four electrode structures have been shown spaced around producing well 16, five, six or more structures can be used depending on the degree of uniformity desired.

In accordance with this invention, A.C. voltages are supplied alternately between electrodes 36 and between electrodes 37 for a sufficient period of time until the temperature of the kerogen in body 10 in the region of apertures 22 in casing 20 is raised to a temperature of, for example, 300° C., such temperature being sensed by any desired means (not shown). The rate of heating of the kerogen in body 10, which is dependent on the voltages supplied to electrodes 36 and 37, is selected preferably to raise the temperature of the ore body around producing well 16 to 300° C. in a reasonable period of time. A substantial portion of the kerogen in the shale is converted into organic products during and/or subsequent to the heating and prior to sufficient heat dissipation from the kerogen to reduce its temperature below 200° C. Fissures in the shale body 10 through which the fluid products converted from kerogen flow into casing 20 are also produced by heating body 10.

Conversion of the kerogen to gaseous and low viscosity liquid organic products proceeds over a period of days, weeks or months after R.F. heating has ceased, and such products flow through the apertures 22, separate, and liquid collects in the sump 30 from whence it is pumped to the surface by the pump 26 upon actuation of the sucker rod 28. If desired, the apertures 22 may be cleaned out by applying back pressure periodically to the tubing 20 using injection pump 78 to blow any portions of the shale oil body which have moved into the apertures 22 back into the body 10. In addition, during and after the heating period, pressure may be produced with gas or fluid to additionally fracture the body 10.

Separated gas may be recovered through valve 74. In accordance with this invention, injection pump 66 can be used to inject gas or steam through apertures 50 in electrodes 36 and 37 into the body 10 to augment the flow of organic products into sump 30. Structures 32 for nonproducing locations may be very small in size, for example, having outer casings 34 two inches in diameter with inner electrode structures 36 one inch in diameter, hence being less costly to install than structures 16.

If it is desired to operate the system with radiated wave energy, the switches 70 are opened, and the switch 72, mechanically ganged to switches 70, is switched to open the conducting lines connected between the casing 18 and one of the casings 34 and to reconnect casing 18 to the opposite end of the secondary winding of transformer 44 from that connected to electrode 20 so that electrical power is supplied only to electrode 20 from amplifier 42, with the casing 18 acting as a ground electrode.

Under these conditions, electrode 20 will radiate energy into the formation 10. The particular impedance of the radiating structure comprising electrode 20 can be matched by changing taps (not shown) on transformer 44 and/or by adding reactive impedances as appropriate to the output of the transformer 44 in accordance with well-known practice.

Production of the organic products of kerogen may begin, for example, after the kerogen in body 10 has been heated to a temperature above 200° C. and enough time has elapsed to produce conversion of a sufficient amount of kerogen to organic liquid and gaseous products of low viscosity which can readily flow to the collecting wells. Such flow may be increased by injecting, with compressors or pumps 66, a gas under pressure, or a liquid such as water which is converted to steam by the heat in the formation. The pressure difference between the injection electrodes 36 and the apertures 22 in electrode 20 will cause the products converted from kerogen to flow through the apertures 22 in the electrode 20, with gaseous products being produced directly through a valve 74 connected to electrode 20 and liquids being produced from tubing 24 by pump 26 through valving system 76. An injection pump or compressor 78 may be used to inject liquid or gas into the electrode 20 to assist in fracturing the formation, to flush the producing formation, or to assist in temperature control of the electrode and/or the formation adjacent thereto.

This completes the description of a particular embodiment of the invention disclosed herein. However, many modifications thereof will be apparent to persons skilled in the art without departing from the spirit and scope of this invention. For example, the use of a wide range of frequencies and electric field patterns can be used, and the injection of hot fluids in conjunction with the supply of R.F. heating can be used. In addition, electrodes positioned at a slant or driven horizontally into the formation from large shafts dug into the shale body may be used. Accordingly, it is desired that this invention be not limited to the particular details disclosed herein except as defined by the appended claims.

What is claimed is:

1. The method of producing organic liquid and gaseous products having low pour points from kerogen contained in a subsurface body of oil shale comprising the steps of:

heating regions of said kerogen in said body to temperatures in the range between 200° C. and 360° C. where kerogen will convert to liquid and gaseous products by subjecting said oil shale to a time varying electric field while producing substantial pressure in fissures produced in said body;

allowing sufficient time to pass to allow substantial conversion of said kerogen to said products; and collecting said products through said fissures.

2. The method in accordance with claim 1 wherein said step of heating said kerogen comprises subjecting said oil shale to an electric field extending between a plurality of electrodes separated by said oil shale.

3. The method in accordance with claim 1 wherein said alternating electric field comprises an electric field extending between a plurality of conductive electrodes separated by a portion of a body of said oil shale.

4. The method of producing organic liquid and gaseous products having low pour points by pyrolytic conversion of kerogen contained in a subsurface body of oil shale comprising the steps of:

producing fissures in said body by heating regions of said body to temperatures in the range between 200° C. and 360° C. comprising subjecting said oil shale to a time varying electric field having a frequency in the range between 100 kilohertz to 100 megahertz;

maintaining said kerogen regions in said temperature range until substantial portion of said kerogen is converted to said products; and collecting said products comprising causing said products to flow through said fissures.

5. The method of producing in situ pyrolytic conversion of kerogen in oil shale comprising the steps of:

subjecting a body of said oil shale to alternating voltage gradients to heat regions of said kerogen to an average temperature in the range from 200° C. to 360° C. without heating adjacent regions of said kerogen to temperatures above 360° C.; and producing converted products of said kerogen from said shale.

6. The method in accordance with claim 5 wherein said step of subjecting said body to said voltage gradients comprises producing an electric field between two or more conductive electrodes separated by a portion of said oil shale body.

7. The method in accordance with claim 6 wherein the frequency of said field is above 100 kilohertz.

8. The method in accordance with claim 5 wherein said electric field is produced by means comprising an electrode in said body.

9. The method of producing organic liquid and gaseous product from kerogen contained in subsurface region of oil shale comprising the steps of:

producing substantial pressure in fissures produced in said body while heating said kerogen to temperatures in the range between 200° C. and 360° C. by subjecting said body to waves of time varying energy having frequencies below 100 megahertz; and collecting said products which flow through said fissures by means comprising a structure through which said products flow out of said region.

10. The method of producing organic liquid and gaseous pyrolyation products from kerogen contained in a subsurface region of oil shale comprising the steps of:

fracturing said region by heating said oil shale by means comprising subjecting said regions to a time varying electric field having a frequency below 100 megahertz while producing substantial pressure in fissures produced in said oil shale; and collecting said products which flow through said fissures to collecting structures through which said products flow out of said body.

11. The method of producing pyrolytic conversion of kerogen in oil shale comprising the steps of:

subjecting a subsurface body of said oil shale to alternating voltage gradients to heat regions of said kerogen to an average temperature in the range of 200° C. to 360° C. while producing substantial pressure in fissures produced in said body; and producing the products of said conversion of kerogen by the flow of said product through said fissures to a collecting structure and through said collecting structure out of said body.

* * * * *